US008225694B2

(12) United States Patent
Kennedy et al.

(10) Patent No.: US 8,225,694 B2
(45) Date of Patent: Jul. 24, 2012

(54) PISTON ROD ASSEMBLY

(75) Inventors: George Coulter Kennedy, Renfrewshire (GB); Arnaud Fusilier, Anould (FR)

(73) Assignee: Spicket Valves and Pumps Limited, Renfrewshire (GB)

( * ) Notice: Subject to any disclaimer, the term of this patent is extended or adjusted under 35 U.S.C. 154(b) by 1518 days.

(21) Appl. No.: 10/595,309

(22) PCT Filed: Oct. 8, 2004

(86) PCT No.: PCT/GB2004/004260

§ 371 (c)(1), (2), (4) Date: Dec. 11, 2006

(87) PCT Pub. No.: WO2005/035986

PCT Pub. Date: Apr. 21, 2005

(65) Prior Publication Data

US 2007/0209473 A1 Sep. 13, 2007

(30) Foreign Application Priority Data

Oct. 8, 2003 (GB) ..... 0323542.1

(51) Int. Cl.
*F04B 53/14* (2006.01)

(52) U.S. Cl. ..... 74/579 R; 403/31; 92/134

(58) Field of Classification Search ..... 74/579 R, 74/582, 583, 593; 24/463, 603; 403/34–39, 403/300–314; 464/24, 27; 417/342; 411/DIG. 3; 92/128; *F04B 53/14*

See application file for complete search history.

(56) References Cited

U.S. PATENT DOCUMENTS

| | | | | |
|---|---|---|---|---|
| 4,033,701 | A * | 7/1977 | Labyer et al. | 403/13 |
| 4,425,050 | A * | 1/1984 | Durand | 403/15 |
| 4,741,402 | A * | 5/1988 | Smith | 166/344 |
| 5,468,106 | A * | 11/1995 | Percival-Smith | 411/434 |
| 5,544,968 | A * | 8/1996 | Goellner | 403/31 |
| 5,904,071 | A | 5/1999 | Kennedy et al. | |
| 6,209,445 | B1 | 4/2001 | Roberts, Jr. et al. | |
| 6,241,492 | B1 | 6/2001 | Pacht | |
| RE37,483 | E | 12/2001 | Kennedy et al. | |
| 6,554,523 | B2 * | 4/2003 | Aday et al. | 403/31 |

FOREIGN PATENT DOCUMENTS

| | | |
|---|---|---|
| DE | 1942247 | 3/1971 |
| GB | 2190170 | 11/1987 |
| WO | 03031819 | 4/2003 |
| WO | 2004106743 | 12/2004 |

* cited by examiner

*Primary Examiner* — James Pilkington
*Assistant Examiner* — Thomas Diaz
(74) *Attorney, Agent, or Firm* — Daniel N. Lundeen; Lundeen & Lundeen PLLC

(57) ABSTRACT

A piston rod assembly for coupling between a power end and a fluid end of a high pressure reciprocating pump. Part cylindrical members are clamped together via pistons arranged orthogonally to the rod axis. The members grip the power and fluid end components in a knuckle joint or ball and socket. By providing orthogonal loading, a large contact area is obtained between the members and the components, which gives a mechanical advantage in keeping the parts together even when a maximum reciprocating force is applied by the pump.

5 Claims, 2 Drawing Sheets

PISTON ROD ASSEMBLY

BACKGROUND OF THE INVENTION

This invention relates to high pressure reciprocating pumps such as those used to pump drilling mud in the oil production industry, including those pumps commonly referred to in the industry as mud and slush pumps. In particular, the invention relates to a piston rod assembly, suitable for rapid replacement between a power end and a fluid end of a reciprocating pump.

It is necessary with high pressure reciprocating pumps to replace the piston or other dynamic component with relative regularity and it is therefore advantageous if this task can be performed quickly and easily. Typical quick release piston rod assemblies, such as those disclosed in GB 2,190,170 and U.S. Pat. No. 5,904,701, have axially arranged links to the power and fluid ends, held in place by radial pins. Tension is then applied to the pins via axial pistons to couple the fluid and power ends together.

A disadvantage of these assemblies is that connectors with suitably sized apertures must be arranged at each of the power and fluid ends. The use of radial pins, to which longitudinal tension is applied, provides weak points on the assembly which can be prone to fracture during high reciprocation. A further disadvantage of these assemblies is that the relative angle between the power end and fluid end must be taken into account when positioning the assembly.

SUMMARY OF THE INVENTION

It is an object of the present invention to provide a piston rod assembly which obviates at least some of the disadvantages of the prior art.

According to the present invention there is provided a piston rod assembly, for coupling between a power end and a fluid end of a high pressure reciprocating pump, the assembly comprising one or more clamping members arranged relative a rod axis between the power end and the fluid end, each member having a first end adapted to grip a power end component and a second end adapted to grip a fluid end component, at least one member including one or more tensioning means, wherein said tensioning means comprise a piston to provide a load in said tensioning means orthogonal to said first rod axis and thereby secure said components against release.

Preferably the clamping members are part cylindrical bodies which when arranged on the rod axis provide a substantially cylindrical body. Preferably there are two clamping members, an upper clamping member and a lower clamping member.

Preferably the first and second ends include a contact face parallel to the rod axis on an inner surface.

Preferably the face provides a recess on the inner surface in which a portion of the power end component or fluid end component may be located such that the component is gripped and held when the clamping members are brought together by the tensioning means. Advantageously each component end and the first/second end provide a knuckle joint. Alternatively, they may provide a ball and socket.

This clamping is obtained without any need of relative angle position between the power end component and the fluid end component. Further when the load is applied on the rod axis, the large contact area between the faces and the components provides a large mechanical advantage thus facilitating a large force to solidly assemble the parts together even when a maximum reciprocating force is provided by the pump.

Preferably each piston is slideable within an hydraulic cylinder. More preferably each piston includes a stem adapted to receive a nut or a lock. Preferably said stems extend from one clamping member through an aperture in an adjacent clamping member. The nut may then engage the stem to couple the clamping members. Preferably also a spring is arranged within the hydraulic cylinder to tension the said stem. Advantageously, the assembly includes non-rotational means for preventing rotation of said stem. The non-rotational means may be a pin locating in a matching recess arranged parallel to the stem.

Preferably a space is defined between a base of the cylinder and a base of the piston for accommodating hydraulic fluid. Preferably the assembly includes a fluid inlet port to permit the input of hydraulic fluid to the cylinder. Advantageously a chamber may be included in each member to provide a common feed for hydraulic fluid to all cylinders within the member.

BRIEF DESCRIPTION OF THE DRAWINGS

An embodiment of the present invention will be described by way of example, with reference to the accompanying drawings, in which.

DETAILED DESCRIPTION OF THE INVENTION

Figure 1:
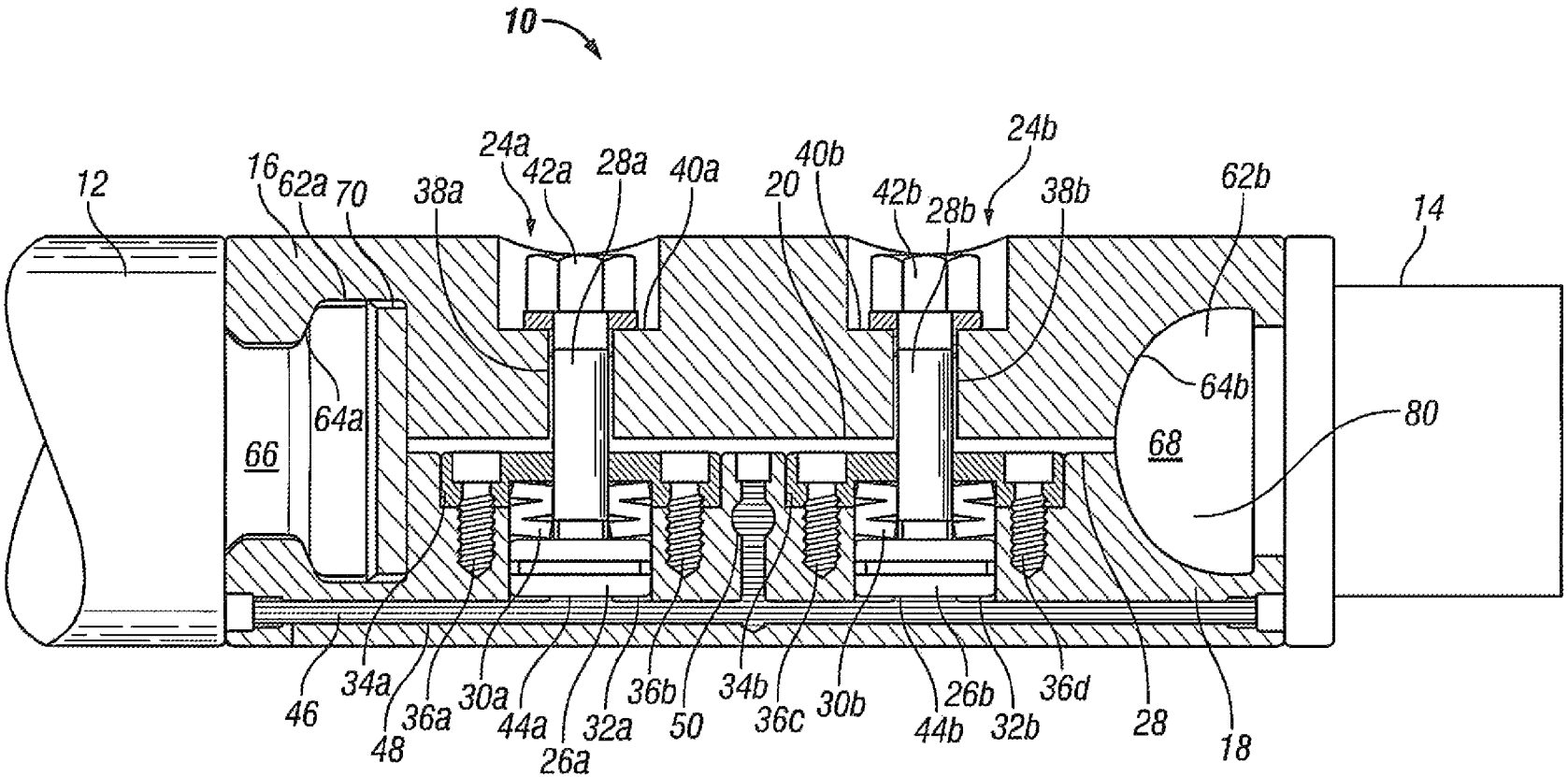
FIG. 1 is a sectional side elevation of a piston rod assembly, according to an embodiment of the present invention.

Reference is initially made to FIG. 1 of the drawings which illustrates a piston rod assembly, generally indicated by reference numeral 10, according to an embodiment of the present invention. Piston rod assembly 10, is located between a power end component 12 and a fluid end component 14. The components 12,14 form parts of a high pressure reciprocating pump as will be recognised by those skilled in the art. In particular the piston rod assembly 10 can be used in a high pressure reciprocating oilfield mud pump.

The piston rod assembly 10 may be considered as a clamping link by virtue of its purpose i.e. to provide a releasable coupling between the power end component 12 and the fluid end component 14 which is secure during the high reciprocating force applied by the pump. Assembly 10 comprises two half-cylindrical clamps 16,18. Each clamp 16,18 has an inner planar surface 20,22 respectively. The surfaces 20,22 are arranged on and lie parallel to the rod axis. The rod axis is a central line located between the end components 12,14.

The piston rod assembly 10 includes two tensioning modules 24*a,b* to connect the clamps 16,18. Each tensioning module includes a piston 26*a,b*, a piston stem 28*a,b*, and a disc spring stack 30*a,b* arranged within a cylindrical housing 32*a,b* with the lower clamp 18. These elements 28,30,32 are all disposed orthogonally to the rod axis of the assembly 10. Covers 34*a,b*, held in place by screws 36*a-d*, close the housings 32*a,b* retaining the spring force. The upper clamp 16 includes apertures 38*a,b* through which extend the stems 28*a,b* from the lower clamp 18. Each aperture 38 widens to provide a lip 40*a,b* parallel to the rod axis. A nut 42*a,b* is screwed to the stem 28*a,b* and may be tightened against the lip 40*a,b*.

Below each piston 26*a,b* in a space defined by the base of the piston 26*a,b* and the base of the housing 32*a,b* is a fluid chamber 44*a,b*. Hydraulic fluid 46 may enter this chamber 44 and exert a force upon the piston 26*a,b*. The chambers are connected to a fluid line 48 located along the length of the assembly 10. The fluid line 48 is sealed, but includes an inlet port 50 illustrated in FIG. 2.

Figure 2:
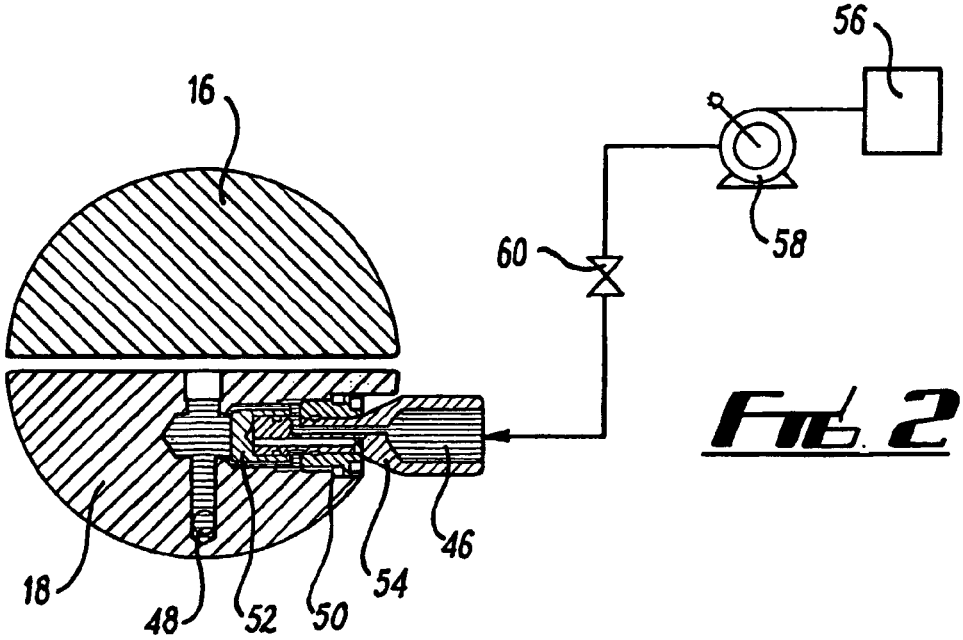
FIG. 2 is a sectional schematic view of a fluid inlet port of a piston rod assembly according to an embodiment of the present invention.

Referring to FIG. 2, the inlet port 50 is now seen in a perpendicular aspect. Like parts to those of FIG. 1 have been given the same reference numeral to aid clarity. A female connector 52 is located with the port 50. By inserting a male connector 54 into the female connector 52 pressurising hydraulic fluid 46 can be inserted into the fluid line 48. It will be recognised by those skilled in the art that the fluid 48 may be supplied from a reservoir 56, utilising a pump 58, through a check valve 60. The connectors 52,54 are preferably quick release connectors and the male connector 54 is a differential pressure fastening, which avoids the need to screw in any device, thus making the task of pressurising and releasing very fast.

Returning to FIG. 1, on the inner surface 20, 22 are arranged recesses 62*a,b*. When the clamps 16, 18 meet the recesses 62*a, b* form circumferential grooves around the inner surface 20, 22 equidistantly from the rod axis. Each component end 12, 14 includes a protrusion 66, 68 which may be likened to a door knob or knuckle in profile. Each protrusion 66,68, lies within a recess 62*a,b* and a large contact surface area 64*a, b* is provided between the protrusion 66,68 and the inner surface 20,22. Additionally as each recess 62*a, b* has an angled surface facing toward the ends 12, 14 respectively; the protrusions 66, 68 are effectively gripped by the clamps 16, 18. To aid the fitting of each protrusion 66, 68 into each recess 62*a, b*, bearing pads 70, 72 are located at the distal ends of the protrusions 66, 68. The bearing pads 70, 72 may be formed of a material which provides some give and has a relatively high elastic modulus.

Figure 3A:
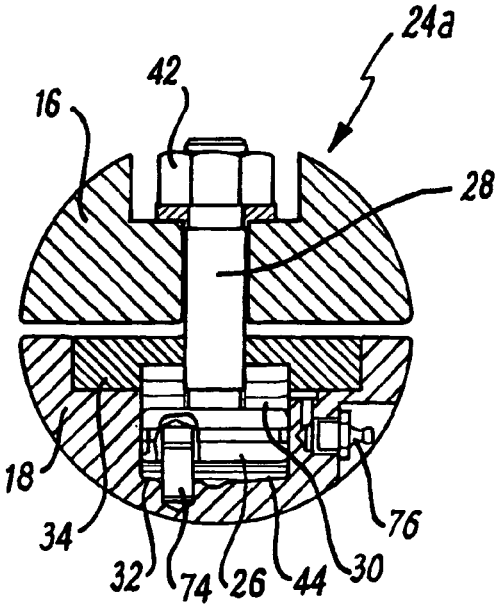
FIGS. 3*a* & 3*b* are sectional views of tensioning means in first (3*a*) and second (3*b*) operating positions.
Figure 3B:
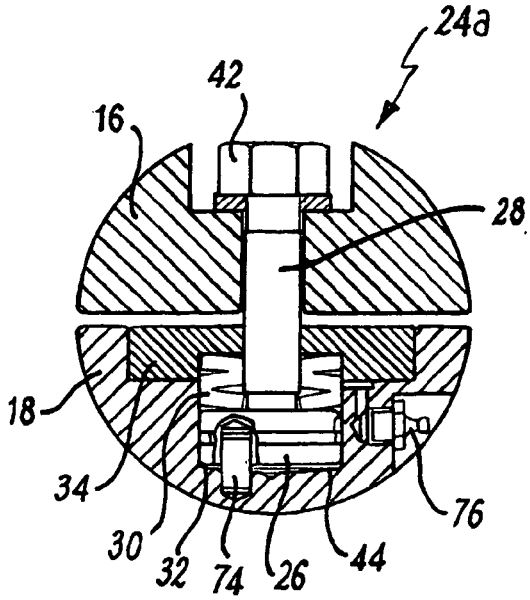

Reference is now made to FIGS. 3*a* and 3*b*. Like parts to those of FIGS. 1 and 2 have been given identical reference numerals to aid clarity. These Figures show operating positions of the assembly and will be described fully hereinafter. Additionally these figures illustrate further features of the assembly 10. An anti-rotation pin 74 is located within the base of the piston 26 and extends into the base of the housing 32. The anti-rotation pin 74 prevents the piston 26 rotating during movement of the nut 42. Also included in the assembly 10 is a grease nipple 76 as is known in the art. The grease nipple 76 fills grease into the disc spring stack 30 to protect the stack 30 from rust.

In use, the lower clamp 18 including the tensioning modules 24 are located against protrusions 66,68 of a power end component 12 and a fluid line component 14 of a pump. The protrusions 66,68 rest in the recesses 62*a,b*. the upper clap 16 is then placed over the lower clamp 18 such that the stems 28*a,b* locate through the apertures 38*a,b* respectively. Nuts 42*a,b* are located on the stems 28*a,b* and hand tightened to align the protrusions 66,68 against the surface 64*a,b*. This process can be done without the need to ensure that the end components 12,14 are perfectly aligned as tightening the nuts 42 will bring the ends 12,14 into alignment. Fluid 48 is then introduced to the line 46. Pressure will consequently build up in the chambers 44*a,b* and the pistons 26*a,b* will be forced upwards by a short distance, orthogonal to the rod axis. This is illustrated in FIG. 3*a*. The nuts 42*a,b* are given freedom to be tightened by further rotation along the stems 28*a,b* towards the lips 40*a,b*. It should be noted that the apparatus and method described herein allows the nuts 40*a,b* to be tightened by hand by means of a socket wrench. It will be appreciated that this is a considerable advantage over the requirement of using heavy tools.

When fluid pressure in the chambers 44*a,b* is released by removal of the fluid 46, the pistons 26*a,b* are pushed outwards towards the base of the housing 30*a,b* by the spring stacks 30*a,b*. This places in shear (locking arrangement) the clamps 16,18 and the bearing pads 70,72. The end components 12,14 are now securely attached to the clamping link or assembly 10. This is illustrated in FIG. 3*b*. Further with the load applied on the rod axis, the large contact area 64*a,b* between the surfaces 20,22 and the components 66,68 provides a large mechanical advantage thus facilitating a large force to solidly assemble the parts together even when a maximum reciprocating force is provided by the pump.

These steps may be repeated any number of times to release or couple the assembly 10 between the ends 12,14.

The principal advantage of the present invention is that by applying a force orthogonally to the rod axis a greater securing force is provided to clamp the assembly to the component ends. This also dispenses with the need to provide apertures through the end components for locking pins.

A further advantage of the present invention is that in bringing the clamps together to grip the ends, the ends need not be in perfect alignment initially. Additionally any dirt which becomes trapped between the clamps, will merely provide a spacing which can be made up be the stacking springs. In this way the dirt will not cause loosening of the clamps during reciprocation of the pump in use.

A yet further advantage of the present invention is that the assembly can be quickly made up without the need for heavy tool to tighten the nuts.

It will be appreciated by those skilled in the art that various modifications may be made to the invention herein described without departing from the scope thereof. For example, any number of tensioning modules may be incorporated, as could numbers of clamps depending on the shape of the protrusions at each of the ends. Additionally, though spring stacks have been used to provide tension in the piston housings, other elastic members could be substituted. Further, a water flushing pipe as is known in the art may be incorporated to remove dirt and provide lubrication and cooling to the system.

The invention claimed is:

1. A piston rod assembly for coupling between a power end component and a fluid end component of a high pressure reciprocating pump, the assembly comprising, an upper clamping member and a lower clamping member each having a fluid end recess and a power end recess on an inner surface of each clamping member arranged along an axis of the components, wherein a portion of each component is gripped and held within each of the respective recesses wherein the clamping members are brought together by a tensioning device located orthogonal to the axis of the components, wherein the tensioning device comprises a stem adapted to receive a nut or a lock, wherein the tensioning device is engaged in a non-rotational arrangement within the lower clamping member and the stem extends through an aperture in the upper clamping member, wherein a nut engages the stem and the upper clamping member to provide tension in said tensioning device such that the clamping members are brought together by the tensioning device.

2. The piston rod assembly of claim 1, wherein the tensioning device includes at least one spring to bias the upper and lower clamping members into locking arrangement.

3. The piston rod assembly of claim 2, wherein the spring comprises a disc spring, a disk spring stack, a spring stack, an elastic member, or a combination thereof.

4. The piston rod assembly of claim 1, wherein the non-rotational arrangement comprises a recess disposed within the lower clamping member arranged parallel to the stem.

5. The piston rod assembly of claim 1, wherein the fluid end recess, the power end recess or both the fluid end recess and the power end recess include a bearing pad comprising a material having an elastic modulus suitable to provide give between the assembly and the power end component, the fluid end component or both the power end component and the fluid end component when the component is gripped and held within the recess.

* * * * *